US008794350B2

(12) United States Patent
Alberty

(10) Patent No.: US 8,794,350 B2
(45) Date of Patent: Aug. 5, 2014

(54) METHOD FOR DETECTING FORMATION PORE PRESSURE BY DETECTING PUMPS-OFF GAS DOWNHOLE

(75) Inventor: Mark William Alberty, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 1607 days.

(21) Appl. No.: 12/004,175

(22) Filed: Dec. 19, 2007

(65) Prior Publication Data

US 2009/0159337 A1 Jun. 25, 2009

(51) Int. Cl.
*E21B 47/00* (2012.01)

(52) U.S. Cl.
USPC ..... 175/50

(58) Field of Classification Search
USPC ..... 175/42, 50; 73/19.01–19.12
See application file for complete search history.

(56) References Cited

U.S. PATENT DOCUMENTS

| | | | | |
|---|---|---|---|---|
| 3,872,721 | A | 3/1975 | Ilfrey | |
| 4,412,130 | A | 10/1983 | Winters | |
| 4,442,011 | A | 4/1984 | Thaler et al. | |
| 4,447,338 | A | 5/1984 | Lundberg et al. | |
| 4,949,575 | A | 8/1990 | Rasmus | |
| 5,214,251 | A | 5/1993 | Orban et al. | |
| 5,354,956 | A | 10/1994 | Orban et al. | |
| 5,741,962 | A | 4/1998 | Birchak et al. | |
| 5,850,369 | A | 12/1998 | Rorden et al. | |
| 5,859,430 | A | 1/1999 | Mullins et al. | |
| 6,119,772 | A * | 9/2000 | Pruet | 166/81.1 |
| 6,176,323 | B1 | 1/2001 | Weirich et al. | |
| 6,208,586 | B1 | 3/2001 | Rorden et al. | |
| 6,230,557 | B1 | 5/2001 | Ciglenec et al. | |
| 6,237,404 | B1 * | 5/2001 | Crary et al. | 73/152.03 |
| 6,401,538 | B1 | 6/2002 | Han et al. | |
| 6,465,775 | B2 | 10/2002 | Mullins et al. | |
| 6,484,816 | B1 | 11/2002 | Koederitz | |
| 6,598,457 | B2 * | 7/2003 | Sullivan et al. | 73/19.01 |
| 6,640,625 | B1 | 11/2003 | Goodwin | |
| 6,670,605 | B1 | 12/2003 | Storm, Jr. et al. | |
| 6,675,914 | B2 * | 1/2004 | Masak | 175/48 |
| 6,954,066 | B2 | 10/2005 | Siess et al. | |
| 6,995,360 | B2 | 2/2006 | Jones et al. | |
| 6,995,369 | B1 | 2/2006 | Lent et al. | |
| 7,036,362 | B2 | 5/2006 | Haddad et al. | |
| 7,185,718 | B2 * | 3/2007 | Gardes | 175/62 |
| 7,280,918 | B2 | 10/2007 | Williams | |

(Continued)

FOREIGN PATENT DOCUMENTS

| | | | |
|---|---|---|---|
| CA | 2298252 | A1 | 8/2000 |
| CA | 2512443 | A1 | 7/2005 |

(Continued)

OTHER PUBLICATIONS

Badry, Downhole Optical Analysis of Formation Fluids, Oilfield Rev. v. 6, No. 1, pp. 21-28, Jan. 1994.

Wright, Estimation of Gas/Oil Ratios and Detection of Unusual Formation Fluids From Mud Logging Gas Data, 37th Annu. SPWLA Logging Symp. , New Orleans, 14 pp., Jun. 16-19, 1996.

(Continued)

*Primary Examiner* — Shane Bomar
*Assistant Examiner* — Kipp Wallace
(74) *Attorney, Agent, or Firm* — Barbara Fisher

(57) ABSTRACT

A method for the detection of gas invading a wellbore during drilling by the influx of fluids which contain gas from the formations penetrated by a wellbore.

20 Claims, 2 Drawing Sheets

(56) References Cited

U.S. PATENT DOCUMENTS

| | | | | |
|---|---|---|---|---|
| 7,331,223 | B2 | 2/2008 | Zazovsky | |
| 2002/0134587 | A1 | 9/2002 | Rester et al. | |
| 2003/0029241 | A1 | 2/2003 | Mandal | |
| 2004/0065477 | A1* | 4/2004 | Paulk et al. | 175/50 |
| 2004/0218176 | A1 | 11/2004 | Shammal et al. | |
| 2005/0205256 | A1 | 9/2005 | DiFoggio | |
| 2005/0224229 | A1 | 10/2005 | Blacklaw | |
| 2005/0241382 | A1* | 11/2005 | Coenen | 73/152.19 |
| 2005/0262936 | A1 | 12/2005 | DiFoggio | |
| 2006/0032301 | A1* | 2/2006 | DiFoggio | 73/152.18 |
| 2006/0272860 | A1* | 12/2006 | Sweatman et al. | 175/50 |
| 2007/0129901 | A1 | 6/2007 | DiFoggio et al. | |
| 2007/0227241 | A1 | 10/2007 | DiFoggio | |
| 2008/0047337 | A1 | 2/2008 | Chemali et al. | |
| 2009/0159334 | A1 | 6/2009 | Alberty | |

FOREIGN PATENT DOCUMENTS

| | | | |
|---|---|---|---|
| EP | 0671547 | | 9/1995 |
| GB | 2354783 | | 4/2001 |
| WO | 99/00575 | | 1/1999 |
| WO | 00/49268 | | 8/2000 |
| WO | 01/63094 | A1 | 8/2001 |
| WO | 01/73424 | A1 | 10/2001 |
| WO | 02/084334 | A1 | 10/2002 |
| WO | 2007/124330 | | 11/2007 |
| WO | 2009/029860 | | 3/2009 |
| WO | 2009/032729 | | 3/2009 |
| WO | 2009/085496 | | 7/2009 |

OTHER PUBLICATIONS

Dong, In-Situ Contamination Monitoring and GOR Measurement of Formation Fluid Samples, Society of Petroleum Engineers, Oct. 2002, SPE 77899.

Dong, Downhole Measurement of Methane Content and GOR in Formation Fluid Samples, Society of Petroleum Engineers, Apr. 2003, SPE 81481.

Dong, Advances in Downhole Contamination Monitoring and GOR (Gas Oil Ratio) Measurement of Formation Fluid Samples, 44th Annu. SPWLA Logging Symp. Galveston, Jun. 22-25, 2003.

Elshahawi, Insitu Characterization of Formation Fluid Samples—Case Studies, Society of Petroleum Engineers, Sep. 2004, SPE 90932.

Elshahawi, Accurate Measurement of the Hydrogen Sulfide Content in Formation Fluid Samples—Case Studies, Society of Petroleum Engineers, Oct. 2005, SPE 94707.

Von Flatern, Delivering the Perfect Formation Fluid Sample, Offshore Engineer v. 31, pp. 29-30, 32-33, Feb. 2006.

Dong, Focused Formation Fluid Sampling Method, Offshore, v.66, No. 3, pp. 36, 38, Mar. 2006.

Hall, Real-Time Formation Fluid Evaluation Using Direct Mass Spectrometry, Annual AAPG Convention, Houston, TX, Apr. 9-12, 2006.

International Search Report and the Written Opinion dated Mar. 20, 2009 for International Application No. PCT/US2008/084630.

Doyle et al., "Plan for Surprises: Pore Pressure Challenges during the drilling of a Deepwater Exploration Well in mid-winter in Norway", SPE/IADC 79848 (Copyright 2003).

* cited by examiner

METHOD FOR DETECTING FORMATION PORE PRESSURE BY DETECTING PUMPS-OFF GAS DOWNHOLE

FIELD OF THE INVENTION

The present invention relates to the quantification of formation pore pressure through the detection of gas entering into a wellbore during drilling by the potentially subtle influx of fluids containing gas from the formations penetrated by a wellbore by detecting the gas during a pumps-off period.

BACKGROUND OF THE INVENTION

Drilling techniques for producing wellbores to great depths in the earth are well known and are widely used, especially in the exploration for and production of hydrocarbons. These wells are typically produced by the use of a drill bit positioned on the lower end of a drill string which is supported for rotation to cause the bit to drill into the earth with the drilling being stopped periodically, with the drill string being lifted and supported on slips or similar devices so that a new section of pipe can be attached to the top drill pipe section. These drill pipe sections are fitted with upset ends so that they can be threaded with male fittings on one end and female fittings on the other end. These drill pipe sections are typically about 30 feet long and when joined together can be used to drill for great distances into the earth.

In drilling such boreholes into the earth, it is not uncommon to case the upper portions of the well after it has been drilled to a suitable depth. Frequently the diameter of the wellbore is decreased as it is drilled deeper into the earth. These techniques are well known to those skilled in the art.

During drilling a drill string is positioned from a surface into the wellbore and to the bottom of the wellbore so that the bit can be rotated. The bit is typically rotated by passing a drilling fluid downwardly through the drill pipe to drive the drill bit and extend the bottom of the hole downwardly.

Drilling fluids are well known and comprise water-based drilling fluid and oil-based drilling fluid. Further specialized drilling fluids, such as drill-in fluids may also be used. The drilling fluids are typically made up to have a specific gravity so that a column of drilling fluid of a height equal to the wellbore depth exerts a bottom hole pressure equal to the anticipated pressure in the formations penetrated by the wellbore over the entire depth of the well. This drilling fluid pressure tends to inhibit the production of gases and oil formation fluids into the wellbore or to the surface when greater than the formation pressure. It also inhibits events such as kicks and blow-outs where high pressure permeable formations are encountered. The industry has developed numerous techniques for detecting such kicks and blow-outs early to prevent significant damage to the drilling apparatus and to prevent blowing the entire mud column out of the wellbore and possibly contaminating the surrounding area with hydrocarbons.

One technique for identifying such high-pressure formations is shown in U.S. Pat. No. 5,214,251 issued May 5, 1993, to Orban, et al (the '251 Patent) and assigned to Schlumberger Technology Corporation. A second closely related patent is U.S. Pat. No. 5,354,956 issued Oct. 11, 1994 to Orban, et al (the '956 Patent) and assigned to Schlumberger Technology Corporation. Both these patents are hereby incorporated in their entirety by reference. These references disclose methods for detecting large gas bubbles which may be discharged into the wellbore from a high-pressure formation (kicks) and possibly damage the well and blow all the drilling fluid from the well onto the earth surface.

It is highly desirable that such conditions be identified prior to drilling into such high-pressure formations so that the weight of the drilling fluid can be adjusted to prevent the blow-out.

Accordingly, considerable effort has been directed to the development of methods for detecting subtle amounts of gas invading a wellbore as drilling is conducted. It is recognized that it would be desirable to know the pressure of small amounts of gas in the drilling fluid. Many wells are drilled slightly under-balanced. In other words, the drilling fluid is pumped into the drill pipe at a pressure such that the drilling fluid passing through the drill and into the annulus between the outside of the drill pipe and the inside of the borehole is at a pressure slightly less than that anticipated from the formations through which the well passes. This permits the drilling of the well without unduly contaminating the faces and near-wellbore portions of the formations penetrated by the well. Use of over-pressure drilling can force drilling fluid into the formations penetrated by the wellbore. Drilling fluid components in the well formation faces and near-wellbore portions of the formation can be detrimental to the production of fluids from the formation after the well has been completed.

In other instances, the well may be drilled slightly over-balanced but the drilling fluid may have a weight insufficient to maintain over-balance on the well if the pumps are stopped. This is also an under-balanced condition when the pumps are off. Such conditions exist periodically during the drilling operation because it is periodically necessary to stop the pumps, disconnect from the drill pipe and add a new section of drill pipe to allow the drilling to proceed to an even greater depth. The pressure resulting from the weight of the column of the drilling fluid is referred to as a hydrostatic pressure. This hydrostatic pressure also can be greater than or less than the pressure in the formation. Desirably this hydrostatic pressure is to be slightly greater than the pressure in the formations penetrated by the wellbore for a safety perspective. The desire of this invention is to detect the condition of the hydrostatic pressure being slightly less than the pressure in the formations penetrated by the well when these conditions are first observed in the pumps off condition when the hydrostatic pressure in the well is slightly less than in the pumps on condition.

Of course if an over-balance, i.e., a pressure greater than the pressure in the pores of the formations penetrated by the wellbore is used then little, if any, gas will enter the wellbore from the formations during drilling. There may be gas associated with the formation that has been excavated by the bit that is released as the formation cuttings are returned to the surface but the amount of gas present will then be independent of the pumps-on/pumps-off condition. When an over-balanced condition exits, portions of the drilling fluid will enter the formations and constitute an obstacle to the production of fluids from the formations.

In a preferred embodiment the hydrostatic pressure in the well during pumping of the drilling fluid is slightly over-balanced relative to the formation pressure with the hydrostatic pressure being slightly less when the pumps are off. In such instances very small amounts of formation gas can enter the wellbore from low permeability formations, such as shale. This gas may exist as a free fluid in the formation or it may be dissolved in water. The presence of this small amount of gas entering the wellbore is indicative that a higher-pressure formation may be exposed in the wellbore. As a result, it is desirable to check this gas periodically to determine whether the amount of gas entering the well under comparable conditions is increasing or stable when pumps are turned on and off.

The most commonly used methods of making this determination is to separate the gas from the drilling fluid at the surface. This is an effective method for determining how much gas may be in the drilling fluid but unfortunately in a well of any substantial depth it may take two to three hours for this drilling fluid to reach the earth surface. This may be too late to avoid drilling into a high-pressure formation without making adequate preparations.

Accordingly an improved method has been sought for determining the amount of gas in the drilling fluid at a given time without the long wait for the drilling fluid to move to the earth surface.

SUMMARY OF THE INVENTION

The present invention comprises a method for detecting pumps-off gas in drilling fluid in a wellbore during drilling from an earth surface and penetrating a plurality of subterranean formations, the method comprising: pumping drilling fluid through a drill pipe extending into a wellbore to provide pressure on the drilling fluid in the drill pipe and discharging drilling fluid from a bottom end of the drill pipe into a drill bit and an annulus between an outside of the drill pipe and an inside of the wellbore to drill the wellbore to a greater depth; supporting at least one gas sensor by the drill pipe near the bottom of the drill pipe and positioned and adapted to sense the amount of gas in the drilling fluid in the annulus at a depth of the at least one sensor; detecting the amount of gas in the drilling fluid in the annulus at the level of the at least one sensor during a period when pumping has been stopped; and, comparing the amount of gas in the drilling fluid in the annulus at the level of the at least one sensor to a selected amount of gas.

DESCRIPTION OF PREFERRED EMBODIMENTS

In the discussion of the Figures, the same numbers will be used throughout to refer to the same or similar components.

Figure 1:
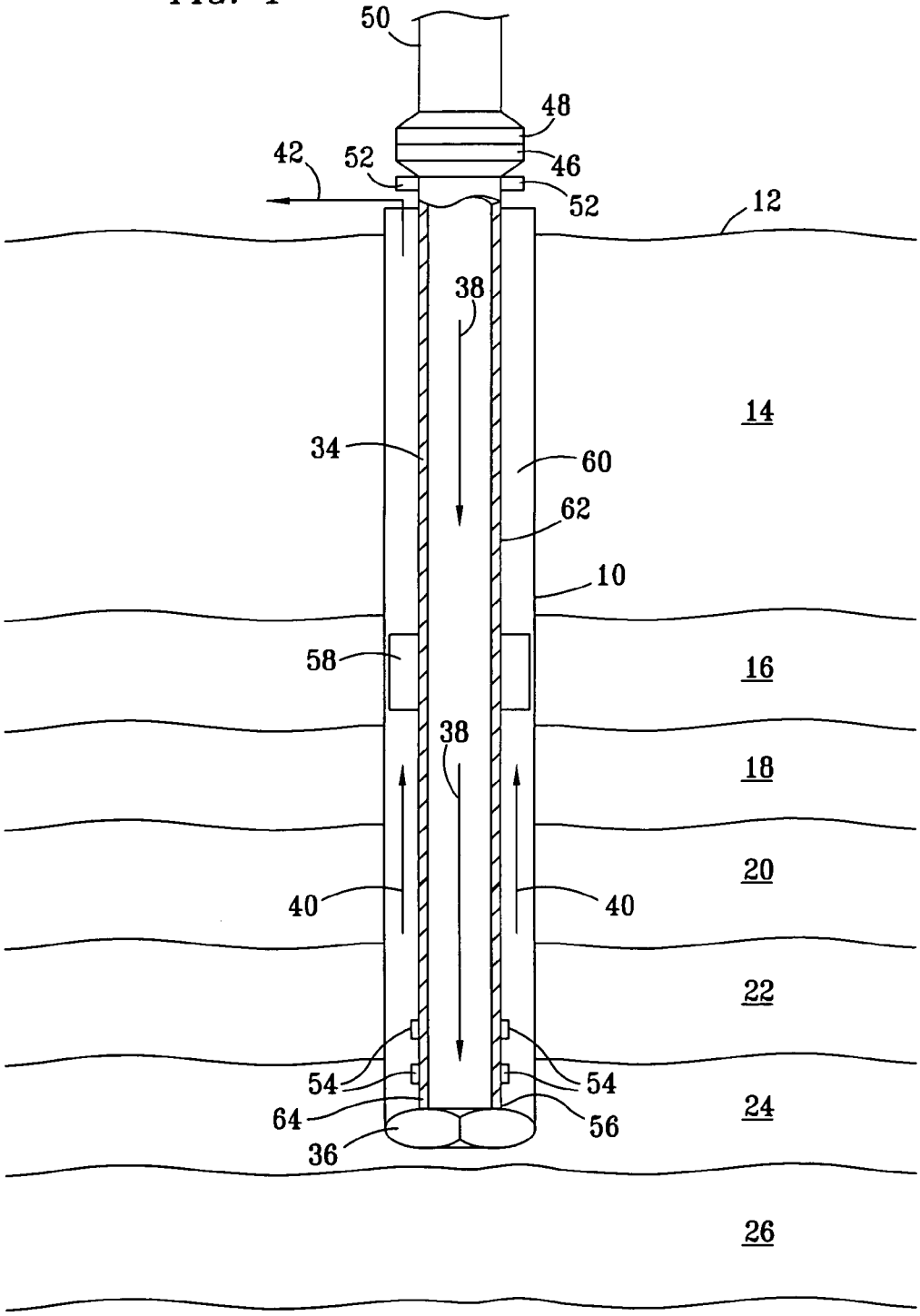
FIG. 1 is a schematic diagram of an embodiment of the present invention; and, FIG. 2 is a schematic diagram of an alternate embodiment of the present invention.

As shown in FIG. 1, a wellbore 10 extends from an earth surface 12 through an overburden 14 and through formations 16, 18, 20, 22, 24 and 26. Some of these formations may be oil-bearing or gas-bearing formations while others may be shale formations which contain over-balanced fluids. A drill pipe 34 is positioned to extend from the earth surface to a drill bit 36. Drilling fluid is pumped through the drill string as shown by arrows 38 and recovered as shown by arrows 40. No equipment has been shown for performing this operation since such equipment is considered to be well known to those skilled in the art. The drilling fluid injected through lines 38 passes through drill bit 36 and is discharged as shown by arrows 40 through an annulus 60 between an inside 44 of wellbore 10 and an outside 62 of drill pipe 34.

As the drilling fluid moves upwardly it is eventually recovered as shown by an arrow 42. This drilling fluid is typically passed to a drill cuttings separation section and is typically degassed and adjusted to the desired composition and thereafter reinjected.

As shown schematically in FIG. 1, a first enlarged section 46 is positioned on an upper end of the drill pipe 34. A second enlarged section 48 is positioned on an end of a second drill pipe 50 so that they may be matingly joined. The slips 52 support slightly lifted drill pipe 34 while second pipe section 50 is joined to the drill pipe 34. Such techniques are considered to be well known to those skilled in the art and do not require further description. A centralizer 58 is commonly used to maintain drill pipe 34 in a central portion of the wellbore.

Sensors 54 are shown near a bottom 64 of the drill string. These sensors are desirably placed at a distance from about 1 to about 200 feet above the bottom 64 of drill pipe 34. These sensors may be positioned as a portion of a drill pipe section or they may be attached to the inside or the outside of the drill pipe. With some types of sensors they could be positioned inside the drill pipe, although it is preferred that they be positioned either in or on the outside of the drill pipe. These sensors are effective to sense the amount of gas contained in the drilling fluid in the annulus, particularly during times when the pumps are turned off. The pressure reduction in the drilling fluid during a pumps-off condition will be substantially less in some wells (about 300 psi) than when the drilling fluid pumps are on. This allows the relatively accurate measurement of the amount of gas entering the wellbore from the formations during the times when the pumps are turned off. This provides an accurate basis for estimating the amount of pressure generated by the formation against the hydrostatic pressure of the drilling fluid. This information is desirably transmitted up the drill string as known to those skilled in the art, by connectors passing along the drill string. While not shown in FIG. 1, a plurality of sensors could be used. The plurality of sensors could be distributed along the drill pipe from the bit back to the surface. These sensors provide information which can be used to determine the amount of gas in the drilling fluid at the bottom of the well during periods when the pumps are shut down.

The sensors may be of any suitable type, such as pulse-echo, density, ultrasonic, velocity, sonic impedance, acoustic impedance and the like, as known to those skilled in the art. The particular type sensors required are not considered to constitute part of the present invention but rather the use of the sensors to perform the method claimed in the present invention is considered to constitute the present invention. The sensors could be positioned on, inside or outside of the drill pipe and adapted to detect comparable values for the drill fluid in the drill pipe and in the annulus.

Figure 2:
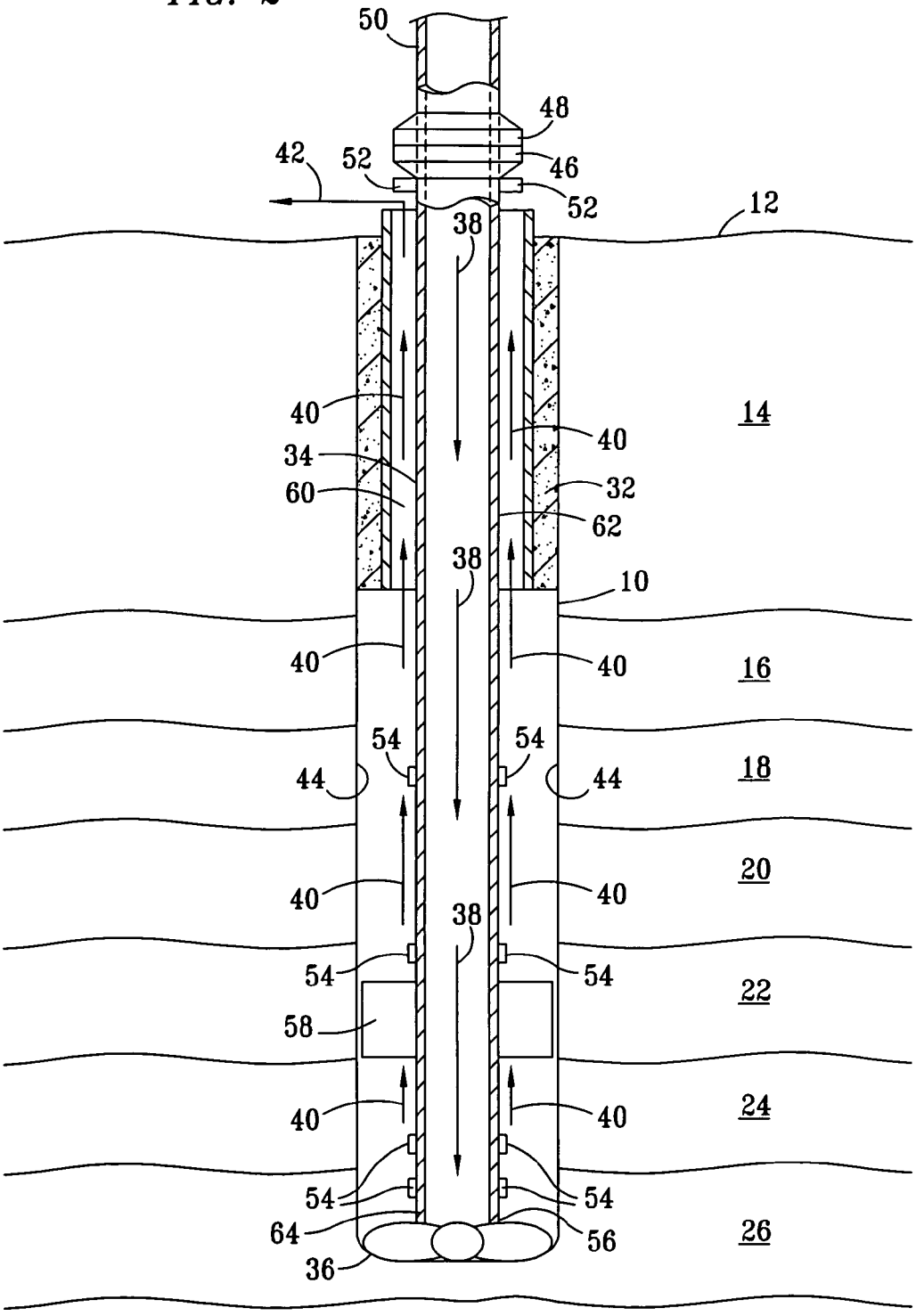

In FIG. 2 a second embodiment of the present invention is shown. In this embodiment the upper portion of wellbore 10 has been cased with a casing 30 supported in place in the wellbore by cement 32. The drilling fluid is injected as described through drill pipe 34 as shown by arrows 38 with the drilling fluid being passed downwardly through drill pipe 34, out through drill 36 and upwardly through the annulus as shown by arrows 40 to recovery through a recovery line 42. In this embodiment, a centralizer 58 is also used. In addition to the sensors positioned near a bottom 64 of drill pipe 34, a plurality of sensors 54 are arranged along the length of drill pipe 34. These sensors will affect a measurement of the amount of gas which may be leaking into the wellbore at levels above the bottom of the wellbore. This can be of considerable interest in the event that formations penetrated by the wellbore tend to become more active in releasing materials into the wellbore at the hydrostatic pressure of the drilling fluid. It will be noted that the hydrostatic pressure of the drilling fluid will be somewhat less at the upper portions of the formation than at the bottom of the wellbore.

By the use of this method, a gas concentration in the drilling fluid may be determined during a pumps-off period and then may be compared to a standard gas amount to determine whether the weight of the drilling fluid should be increased or whether other steps should be taken to control the wellbore. Particularly, it may be desirable to compare this gas measurement to previous gas measurements in the same well taken at an earlier pumps-off period or while the pumps were on. Desirably the gas concentration is measured at each pumps-off period and more frequently if significant changes are detected. This provides an indication as to whether the pressure in the formation is increasing relative to the pressure in the well as indicated by the result of gases entering the wellbore increasing at pumps off conditions. Alternatively, other standards can be adopted to determine whether amounts of gases entering the wellbore are excessive.

By the method of the present invention, it is considered that upon approaching a high pressure formation, an increase in gas entry into the bottom of the wellbore will be detected. This enables the operator to weight the drilling fluid more heavily to impose a back pressure upon the drilling fluid contained in the annulus or the like to control the well.

The present invention provides an effective method for determining a meaningful number related to conditions at the bottom of the borehole in substantially real time. The amount of gas contained in the drilling fluid is indicative of the amount of gas-containing materials entering the wellbore from the surrounding formations. This information is very helpful in controlling the well, adjusting the weight of the drilling fluid and the like.

By the method of the present invention, quantities of gas on the order of 0.01 and up to in excess of 5.0 vol. % as measured at surface conditions or greater can be detected downhole. Typically this method will detect relatively small amounts of gas in the drilling fluid near the downhole sensor to enable the detection of trends. These quantities of gas do not exert appreciable pressure and are detectable at the wellhead using conventional gas detection techniques and while indicative of gas invasion into the well, are not normally detected downhole by existing testing systems for detecting large gas bubbles. The present invention enables early detection of increasing gas levels before the gas concentrations can reach problematic levels. This method may be used by comparing successive readings under similar conditions. An increase in gas from about 1 to about 3 times a background values is of great concern. The background value can be the previous reading or readings or another indicia of the background conditions. This early detection enables the driller to take corrective action much earlier than if the drilling fluid were analyzed for the same or similar information at the surface.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for sensing an amount of gas in drilling fluid in a wellbore during drilling from an earth surface and penetrating a plurality of subterranean formations, the method comprising:

a) pumping drilling fluid through a drill pipe extending into a wellbore to provide pressure on the drilling fluid in the drill pipe and discharging drilling fluid from a bottom end of the drill pipe into a drill bit and an annulus between an outside of the drill pipe and an inside of the wellbore to drill the wellbore to a greater depth;

b) supporting at least one gas sensor by the drill pipe near the bottom of the drill pipe and positioned and adapted to sense the amount of gas in the drilling fluid in the annulus at a depth of the at least one sensor c) sensing information indicating the amount of gas in the drilling fluid in the annulus at the level of the at least one sensor during a period when pumping has been stopped while in one or more relatively low permeation formations; and, d) comparing the amount of gas in the drilling fluid in the annulus at the level of the at least one sensor during said period to a previous amount of gas sensed during a previous period when pumping had been stopped in order to avoid drilling into a relatively high permeability formation before adjustments can be made to prevent a kick or blow out.

2. The method of claim 1 wherein the wellbore is drilled to a greater depth at an under-balanced condition.

3. The method of claim 1 wherein the wellbore is at an under-balanced condition during the period when pumping has been stopped.

4. The method of claim 1 wherein the wellbore is at an under-balanced condition at a hydrostatic drilling fluid pressure.

5. The method of claim 1 wherein a pore pressure of the subterranean formations penetrated by the drill pipe is between a drilling fluid pumping pressure and a hydrostatic drilling fluid pressure.

6. The method of claim 1 wherein the at least one sensor is mounted in a section of drill pipe.

7. The method of claim 1 wherein the at least one sensor is mounted on the outside of the drill pipe.

8. The method of claim 1 wherein the sensor is selected from the group consisting of pulse-echo, density, ultrasonic, velocity, sonic impedance and acoustic impedance sensors.

9. The method of claim 1 wherein the previous period when pumping had been stopped was a period when a new section of drill pipe was added.

10. The method of claim 1 wherein a plurality of sensors are positioned at a plurality of locations along a length of the drill pipe.

11. The method of claim 10 wherein at least one of the pluralities of sensors is positioned at a distance from about 1 to about 200 feet above the drill bit along a length of drill pipe.

12. The method of claim 1 wherein the wellbore is at an under-balanced condition during pumping.

13. The method of claim 1 wherein an upper portion of the wellbore is cased.

14. A method for sensing an amount of gas in drilling fluid in a wellbore during drilling from an earth surface and penetrating a plurality of subterranean formations, the method comprising:

a) pumping drilling fluid through a drill pipe extending into a wellbore to provide pressure on the drilling fluid in the drill pipe and discharging drilling fluid from a bottom end of the drill pipe into a drill bit and an annulus between an outside of the drill pipe and an inside of the wellbore to drill the wellbore to a greater depth;

b) supporting at least one gas sensor by the drill pipe near the bottom of the drill pipe and positioned and adapted to sense the amount of gas in the drilling fluid in the annulus at a depth of the at least one sensor;

c) sensing information indicating the amount of gas in the drilling fluid in the annulus at the level of the at least one sensor during a period when pumping has been stopped while in one or more relatively low permeation formations; and d) comparing the amount of gas in the drilling fluid in the annulus at the level of the at least one sensor during said period to a previous amount of gas sensed during a previous period when pumping had been stopped in order to avoid drilling into a relatively high permeability formation before adjustments can be made to prevent a kick or blow out, wherein the previous period when pumping had been stopped was a period when a new section of drill pipe was added.

15. The method of claim 14 wherein a plurality of sensors are positioned at a plurality of locations along a length of the drill pipe.

16. The method of claim 14 wherein the at least one sensor is mounted in a section of drill pipe.

17. The method of claim 14 wherein a pore pressure of the subterranean formations penetrated by the drill pipe is between a drilling fluid pumping pressure and a hydrostatic drilling fluid pressure.

18. A method for sensing an amount of gas in drilling fluid in a wellbore during drilling from an earth surface and penetrating a plurality of subterranean formations, the method comprising:

a) pumping drilling fluid through a drill pipe extending into a wellbore to provide pressure on the drilling fluid in the drill pipe and discharging drilling fluid from a bottom end of the drill pipe into a drill bit and an annulus between an outside of the drill pipe and an inside of the wellbore to drill the wellbore to a greater depth;

b) supporting a plurality of gas sensors positioned at a plurality of locations along a length of the drill pipe, at least one gas sensor installed near the bottom of the drill pipe and positioned and adapted to sense the amount of gas in the drilling fluid in the annulus at a depth of the at least one sensor;

c) sensing information indicating the amount of gas in the drilling fluid in the annulus at the level of the at least one sensor during a period when pumping has been stopped while in one or more relatively low permeation formations; and d) comparing the amount of gas in the drilling fluid in the annulus at the level of the at least one sensor during said period to a previous amount of gas sensed during a previous period when pumping had been stopped in order to avoid drilling into a relatively high permeability formation before adjustments can be made to prevent a kick or blow out.

19. The method of claim 18 wherein the previous period when pumping had been stopped was a period when a new section of drill pipe was added.

20. The method of claim 18 wherein a pore pressure of the subterranean formations penetrated by the drill pipe is between a drilling fluid pumping pressure and a hydrostatic drilling fluid pressure.

* * * * *